United States Patent [19]

Maire

[11] 4,386,857

[45] Jun. 7, 1983

[54] ELECTRONIC TIMEPIECE WITH AUTOMATIC CORRECTION OF THE VARIATION OF RATE

[75] Inventor: Bernard Maire, Marin, Switzerland

[73] Assignee: Ebauches Electroniques SA, Marin, Switzerland

[21] Appl. No.: 963,992

[22] Filed: Nov. 27, 1978

[30] Foreign Application Priority Data

Feb. 12, 1977 [CH] Switzerland ..... 14763/77

[51] Int. Cl.³ ..... G04C 9/00

[52] U.S. Cl. ..... 368/187

[58] Field of Search ..... 58/23 R, 85.5, 33, 34, 58/35 R, 35 W, 24 R, 24 A, 25

[56] References Cited

U.S. PATENT DOCUMENTS 4,044,547 8/1977 Kusumoto ..... 58/85.5

4,045,952 9/1977 Kashio ..... 58/23 R

*Primary Examiner*—Vit W. Miska

*Attorney, Agent, or Firm*—Wender, Murase & White

[57] ABSTRACT

An electronic timepiece comprising counters and logic devices, in which the counters are utilized to memorize a variation of rate of the timepiece with respect to a time reference in response to actuation of a control means, and in which the logic devices are controlled by signals delivered by the frequency divider chain and are arranged to periodically effect automatic correction of the variation of rate by an amount equivalent to the value memorized in the counters.

The invention relates to a timepiece which permits the user to himself adjust the rate of his watch by means of a simple manipulation not requiring any complicated adjustment of electronic circuits, and which further performs an automatic correction of the variation of rate.

5 Claims, 5 Drawing Figures

ELECTRONIC TIMEPIECE WITH AUTOMATIC CORRECTION OF THE VARIATION OF RATE

BACKGROUND OF THE INVENTION

The invention relates to an electronic timepiece comprising an oscillator, a frequency divider chain, control means, means for time setting, a control circuit for the display and at least one display unit.

The adjustment of rate of the electronic watches is normally carried out at the factory. However, it may happen that after the watch has been carried or worn for some time, the rate may have changed to the dissatisfaction of the customer who therefore needs to have his watch corrected. To do so, he is obliged to visit a watchmaker. This is an undesirable step which is costly and time consuming.

The object of the present invention is to construct an electronic timepiece which permits the user to himself adjust the rate of his watch by means of a simple manipulation not requiring any complicated adjustment of electronic circuits, and which further perform an automatic correction of the variation of rate.

SUMMARY OF THE INVENTION

The electronic timepiece according to the present invention comprises an oscillator, a frequency divider chain, control means, means for the time setting, a control circuit for the display and at least one display unit. The timepiece further comprises two counters for receiving the same signal as that delivered to a seconds counter by the frequency divider chain, the two counters further being responsive to actuation of the control means for memorizing a variation of rate of the timepiece by comparison with a time reference, the variation of rate being represented by the difference between the contents of the two counters. The timepiece also comprises logic circuits controlled by signals delivered by the frequency divider chain and arranged to periodically control the seconds counter as a function of the value and the sign of the variation of rate to automatically correct the variation of rate at the output of the seconds counter.

The present invention will be described further, by way of example, with reference to the accompanying drawings.

DESCRIPTION OF THE PREFERRED EMBODIMENT

Figure 1:
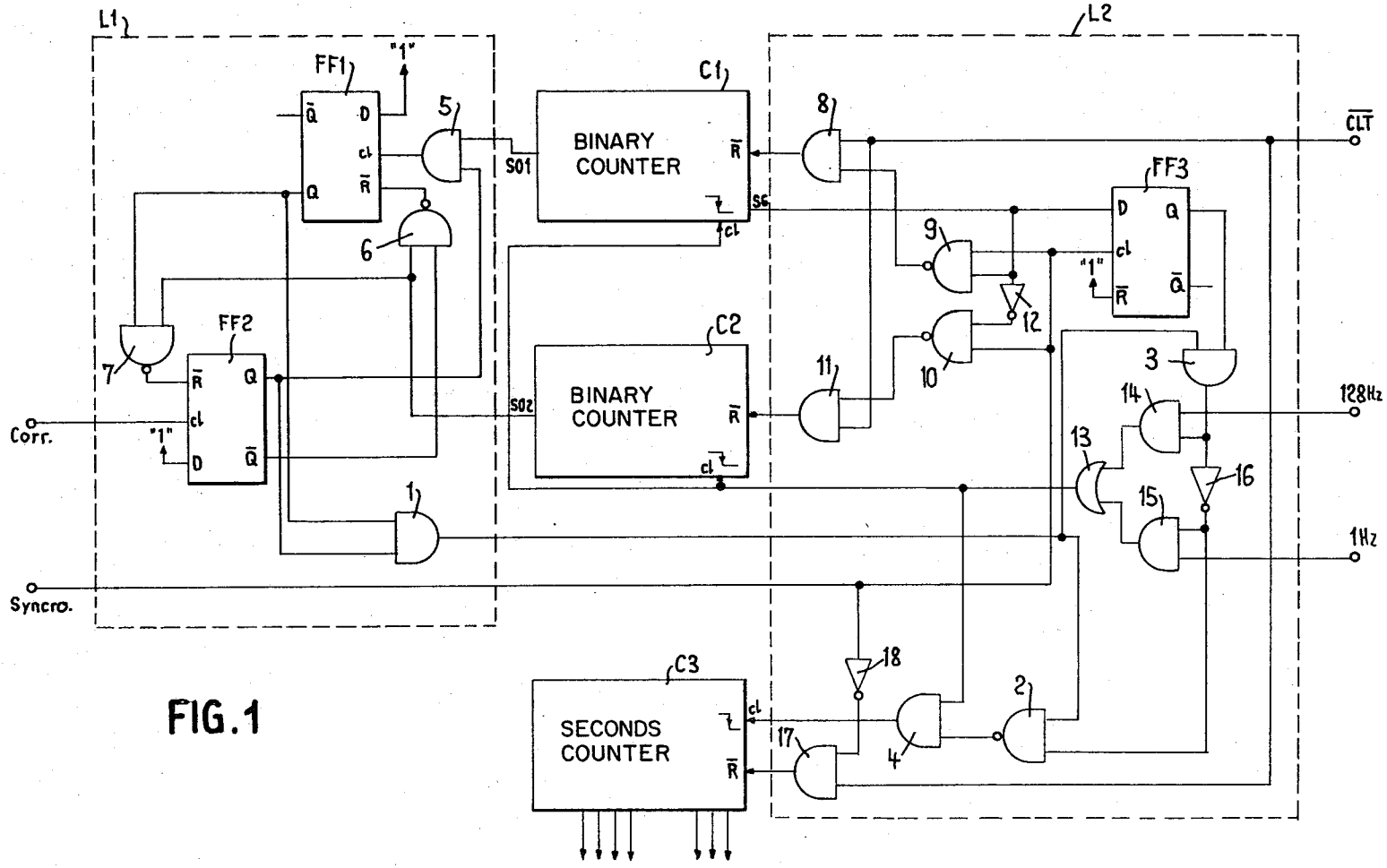
FIG. 1 is a circuit diagram of a system incorporated in an electronic timepiece according to the present invention for automatic correction of rate.

The circuit diagram of FIG. 1 shows that the system for automatic correction of rate comprises two binary counters C1 and C2, each of 6 bits, arranged for counting between 0 and 59, and a seconds counter C3 of the BCD type for counting between 0 and 59 and having outputs for controlling the display and the logic devices L1 and L2. The logic device L1 comprises a D type flip-flop FF1 having its clock input Cl connected to the output of an AND gate 5. A first input of gate 5 is connected to the output SO1 of counter C1. The D input of FF1 is permanently connected to the logic level 1, and the reset input R is connected to the output of a NAND gate 6. A first input of gate 6 is connected to a first input of a NAND gate 7 and to the output SO2 of counter C2. The output Q of FF1 is connected to the second input of gate 7 and to a first input of an AND gate 1. The output of gate 7 is connected to the reset input R of a D type flip-flop FF2 having its clock input Cl connected to input terminal "Corr". The D input of FF2 is permanently connected to the logic level 1, the output Q is connected to the second input of gate 5 and to the second input of gate 1, and the output Q is connected to the second input of gate 6. The logic device L2 receives the signal generated at the output of gate 1 of device L1. The output of this gate 1 is connected to a first input of a NAND gate 2, and to a first input of an AND gate 3. The output of gate 3 is connected to a first input of an AND gate 14, and through an inverter 16, to a first input of an AND gate 15. The seconds inputs of the gates 14 and 15 are connected to 128 Hz and 1 Hz terminals respectively, which receive these signals from the frequency divider chain not represented. The outputs of gates 14 and 15 are connected to the inputs of an OR gate 13 whose output is connected to the clock inputs Cl of the counters C1 and C2, and to a first input of an AND gate 4. The second input of gate 2 is connected to the first input of gate 15, and the output of gate 2 is connected to the second input of gate 4 whose output is connected to the clock input Cl of counter C3. An input "Syncro" is connected through an inverter 18 to the first input of an AND gate 17 whose output is connected to the reset input R of counter C3. The input Syncro is also connected to the first inputs of gates 9 and 10 and to the clock input Cl of a D type flip-flop FF3 whose output Q is connected to the first input of gate 3. The reset input R of FF3 is at logic level 1. The D input of FF3 is connected to the output S6 of the sixth bit of counter C1, to the second input of gate 9, and through an inverter 12 to the second input of gate 10. The outputs of the gates 9 and 10 are connected to a first input of an AND gate 8 and to a first input of an AND gate 11 respectively. The outputs of gates 8 and 11 are connected to the reset inputs R of the counters C1 and C2 respectively. The second input of gate 11 is connected to the second input of gate 8, to the second input of gate 17, and to a terminal CLT which is used to reset the counters C1, C2 and C3 during the operation of time setting of the timepiece.

The working principle of the correcting system is the following. The bearer of the watch must set the watch to time, for example at the moment of a time signal, by delivering through a device not shown a pulse on the terminal CLT. This has the effect of resetting the counters C1, C2 and C3 (see FIGS. 2*a*, and 3*a*). After this operation is completed, the watch then counts a certain lapse of time, e.g. 30 days. At the thirtieth day the watch gives an indication for the bearer to put the watch into a well determined working mode and to actuate, at the moment of a correct time reference signal, a push-button not shown which acts on the terminal Syncro. Afterwards, the watch shall correct itself every 30 days (according to the preceding example) by the proper amount corresponding to the quantity contained in the memory.

Let us examine now what happens when after the 30 day lapse of time, a pulse is given to the Syncro terminal. Two cases will be discussed according to whether the watch is fast or slow.

1. The watch is fast

Figure 2:
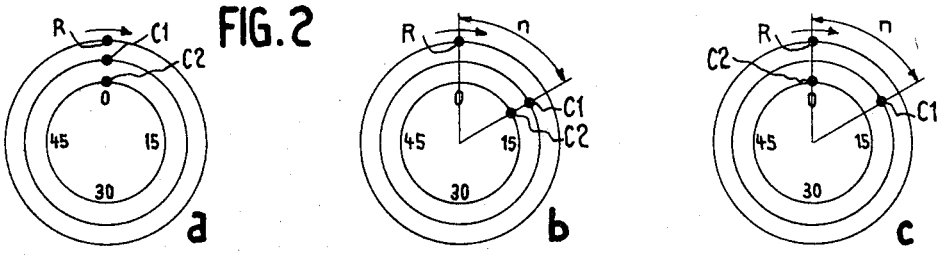
FIG. 2 is a graphical representation which shows the state of the counters at different times when the watch is fast.

In this case, as indicated in FIG. 2*b*, the contents of counters C1 and C2 are such that $$0<C1=C2<31,$$

so that the sixth bit of the contents of C1 is zero. At the moment of a correct time reference signal, the pulse on terminal Syncro which is initiated by the bearer causes FF3 to switch over so that its output Q passes to the logic level 0 closing gate 3. The logic level 0 on the output S6 of C1 closes gate 9 while, because of the inverter 12, gate 10 is opened. Therefore, the pulse on Syncro may reset C2 through gate 11. At the same time the pulse on Syncro resets C3 through the inverter 18 and gate 17. Therefore, after the pulse on Syncro (FIG. 2*c*) the logic state of the counters is as follows: C2 and C3 are at zero, while C1 has not changed from its previous logic state of between 0 and 31. Thus the variation of daily rate is represented at every moment by the difference $n=C1-C2$ between the contents of counters C1 and C2. The difference n is the variation which must be corrected. Since the watch is n seconds fast, it will be necessary to stop the seconds counter C3 for n seconds to correct the deviation of rate.

2. The watch is slow

Figure 3:
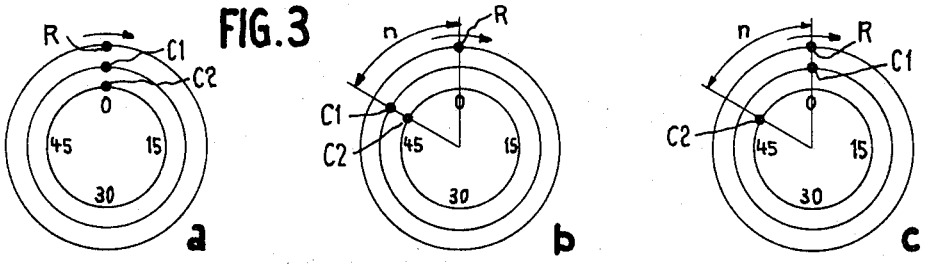
FIG. 3 is a graphical representation which shows the state of the counters at different times when the watch is slow.

Before the pulse arrives on Syncro the contents of counters C1 and C2 are such that $$32<C1=C2<59$$

as shown in FIG. 3*b*. Therefore, the sixth bit at the output S6 of C1 is at logic state 1. The pulse on Syncro, initiated by the bearer at the moment of a time reference signal, causes FF3 to switch over so that its output Q passes to logic state 1 which opens gate 3. The logic state 1 on S6 opens gate 9 and, through inverter 12, closes gate 10. Therefore, the pulse on Syncro resets the counter C1 through gates 8 and 9. At the same time C3 is reset through inverter 18 and gate 17. After the pulse on Syncro, as indicated in FIG. 3*c*, the logic state of the counters is as follows: C1 and C3 are at zero, while C2 has not changed from its previous logic state of between 32 and 59. FIG. 3*c* shows that as in the preceding case, the value n to be corrected is given by the difference $n=C1-C2$ of the contents of counters C1 and C2. The watch being n seconds slow it will be necessary to quickly deliver n additional pulses to the seconds counter C3 to correct the deviation of rate.

Let us now examine what happens periodically, e.g. every 30 days, at the moment of the automatic correction of the variation of rate. The terminal Corr periodically receives a pulse delivered by a counter incorporated in the frequency divider chain, such as the counter of days or the counter of months of the timepiece. These counters which belong to the frequency divider chain are not shown. As before, two cases of automatic correction will be discussed according to whether the watch is fast or slow.

1. The watch is n seconds fast

Figure 4:
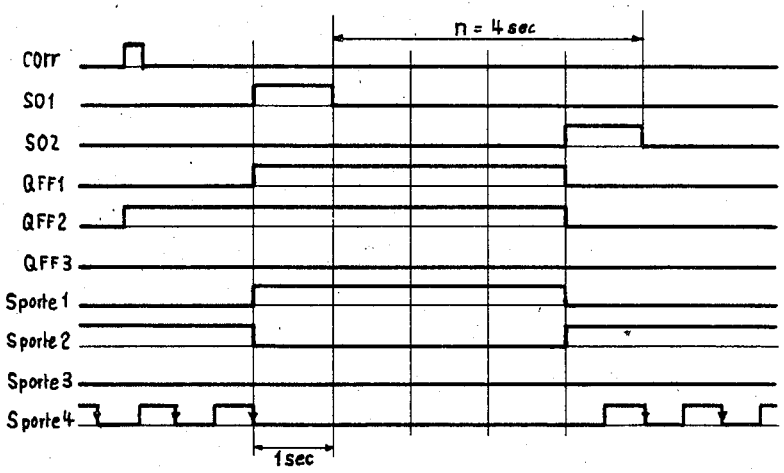
FIG. 4 is a pulse diagram when the timepiece shows a gain.

It will be, therefore, necessary to stop the timepiece for n seconds to set it to the right time. FIG. 4 is the pulse diagram showing the pulses at different points of the circuit of FIG. 1. At the moment of a pulse on Corr, FF2 switches over and its output Q passes to logic state 1 which opens gate 5. Then nothing happens until counter C1 reaches zero. The counters C1, C2 and C3 continue to receive the pulses of 1 Hz delivered by the frequency divider chain. When C1 arrives at zero, its output SO1 switches over from 0 to 1, causing FF1 to switch over so that its output Q passes from 0 to 1. Both memories FF1 and FF2 being activated, the output of gate 1 switches over from 0 to 1. Since when the watch is fast the output Q of FF3 is at 0, the output of gate 3 is also at 0, which closes gate 14 and opens gate 15 through the inverter 16. As a result, the 1 Hz signal is delivered to the counters C1 and C2 through gates 15 and 13. Both inputs of gate 2 being at 1, gate 4 is closed so that from the moment when C1 reaches zero, the counter C3 does not receive anymore clock pulses. However, counters C1 and C2 continue to count, and when counter C2 reaches zero its output SO2 switches over from 0 to 1. This resets the memories FF1 and FF2 through gates 6 and 7 so that the output of gate 1 switches over from 1 to 0, having no effect on the 1 Hz signal still present at output of gate 13. The output of gate 2 switches over from 0 to 1 which opens gate 4, and the 1 Hz signal again reaches counter C3 which then counts normally. Thus during a time interval of n seconds between the moment C1 arrives at zero and the moment C2 arrives at zero, counter C3 is stopped. This condition corresponds to the correction to be made to correct the gain of the watch.

2. The watch is n seconds slow

Figure 5:
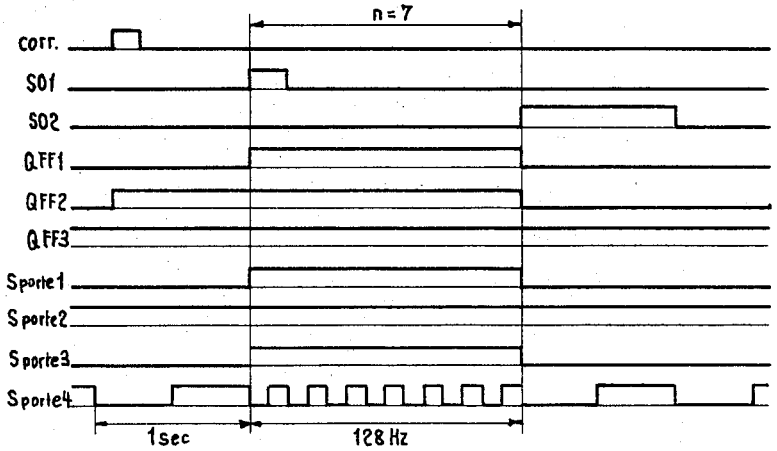
FIG. 5 is a pulse diagram when the timepiece shows a loss.

It will be necessary, therefore, to rapidly generate n additional pulses to correct the loss of time. FIG. 5 is the pulse diagram showing the pulses at different points of the circuit of FIG. 1. At the moment of a pulse on Corr, FF2 switches over and its output Q passes from 0 to 1 which opens gate 5. Then nothing happens until C1 reaches zero.

The counters C1, C2 and C3 continue to normally receive the 1 Hz pulses of the frequency divider chain. When C1 arrives at zero, its output SO1 passes from 0 to 1. The memories FF1 and FF2 thus being activated, the output of gate 1 switches over from 0 to 1. The output Q of memory FF3 is at state 1 because the watch is in the condition of being slow, causing the output of gate 3 is state 1. This opens gate 14 and closes gate 15 through inverter 16. As a result, the 128 Hz signal is delivered to counters C1 and C2 through gate 4 which is opened by gate 2 whose output is at state 1. Thus from the moment when C1 arrives at zero, the three counters C1, C2 and C3 receive the 128 Hz signal. When C2 arrives at zero, its output SO2 switches over from 0 to 1 causing the reset of FF1 and FF2 through gates 15 and 13. The gate 4 is then opened by the logic level 1 at the output of gate 2, so that the counter C3 again receives the 1 Hz signal and counts normally. Therefore, all counters receive n pulses with a frequency of 128 Hz between the moment C1 is at zero and the moment C2 arrives at zero. These pulses representing the number memorized by the difference between the contents of counters C1 and C2 correspond to the correction to be made to correct the loss of the watch.

If the logic devices L1 and L2 are considered from the point of view of their working principle the following may be said.

The logic device L1 comprises a memory FF2 (for the signal Corr) and a memory FF1 (for the logic state of counter C1) which are associated to a memory selector with gates 5, 6 and 7 which is controlled by the outputs SO1 and SO2 of counters C1 and C2, and a locking device formed by gate 1.

The logic device L2 comprises a memory FF3 for the sign of the correction, a frequency selector formed by gates 13, 14 and 15 and the inverter 16, a reset selector for counters C1 and C2 with gates 8, 9 10 and 11 and the inverter 12, and a locking device formed by gates 2, 4 and 17 and inverter 18.

It is obvious that the time interval between the automatic corrections need not to be always 30 days. It can be any other suitable time interval, such as 10 or 20 days. This would permit correction of any value of deviation of rate, which could be greater or smaller than ±30 seconds over the correcting period.

Similarly, the indication given by the watch to the user to operate the synchronization of the watch (pulse on Syncro) at the moment of a time reference signal may be exhibited in different ways: by blinking of the display or a portion of it for watches with a digital display, by limping of the seconds hand for the watches with analog display, by an acoustic signal occuring periodically, by the appearance on the display of a sign or a word, and so on.

The system described above has the advantage that the user can himself effect the correction of the variation of rate of his timepiece without making any complicated manipulation. He needs only, at the moment of a time reference signal, to initiate a synchronization pulse in order to memorize the variation of rate of the watch. Then, at well determined intervals of time, the watch will automatically correct its own variation of rate without any further intervening from the user.

What I claim:

1. An electronic timepiece having automatic correction of the variation of rate, comprising:

means for producing time base pulses;

first, second, and third counters connected to said time base pulse producing means for counting said time base pulses;

means for resetting said first, second, and third counters in response to a first manually produced time signal;

sign memory means coupled to one of said counters and being responsive to a second time signal manually produced at the end of an exactly predetermined period of time after said first time signal for detecting and memorizing from the state of said one counter whether there has been a gain or loss of the timepiece within said period of time;

reset selecting means coupled to said sign memory means, said first counter, and said second counter for receiving a signal indicating a gain or loss, from said sign memory means said reset selecting means further being responsive to said second time signal for resetting said second counter when said sign memory signal indicates a gain, and for resetting said first counter when said sign memory signal indicates a loss; and correcting means connected to said first, second, and third counters, being responsive to a periodic pulse automatically produced by said time base pulse producing means and to said sign memory signal, for preventing said third counter from receiving a number of pulses corresponding to the difference between the states of said first and second counters whenever said sign memory signal indicates a gain, and for delivering said number of pulses to said third counter whenever said sign memory signal indicates a loss, so as to periodically effect automatic correction of the variation of rate represented by said difference.

2. The invention as recited in claim 1, wherein said correcting means comprises:

a frequency selector coupled with said means for producing time base pulses, said sign memory means, and said correcting means for selecting pulses of rapid frequency produced by said time base pulse producing means, so that said number of pulses are delivered to said third counter at said rapid frequency.

3. The invention as recited in claim 1, wherein said reset selecting means includes means for producing a reset signal in response to said second manual time signal coinciding with a normal time setting operation of the watch.

4. An electronic timepiece with automatic correction of the variation of rate having an oscillator, a frequency divider chain, control means, means for time setting, a control circuit for the display and at least one display unit, comprising:

a seconds counter for counting a signal produced by said frequency divider chain;

two counters each receiving the same signal as that delivered to said seconds counter by said frequency divider chain, said two counters being able to memorize under the action of the control means a variation of rate of the timepiece by comparison with a time reference, said variation of rate being represented by the difference between the contents of said two counters; and first and second logic circuits controlled by signals delivered by the frequency divider chain, said logic circuits being arranged to periodically control the seconds counter as a function of the value and the sign of said variation of rate to automatically correct the variation of rate at the output of said seconds counter;

said first logic circuit having two memories associated to a memory selector controlled by the outputs of said two counters, and further having a locking device comprising one gate.

5. An electronic timepiece with automatic correction of the variation of rate having an oscillator, a frequency divider chain, control means, means for time setting, a control circuit for the display and at least one display unit, comprising:

a seconds counter for counting a signal produced by said frequency divider chain;

two counters each receiving the same signal as that delivered to said seconds counter by said frequency divider chain, said two counters being able to memorize under the action of the control means a variation of rate of the timepiece by comparison with a time reference, said variation of rate being represented by the difference between the contents of said two counters; and first and second logic circuits controlled by signals delivered by the frequency divider chain, said logic circuits being arranged to periodically control the seconds counter as a function of the value and the sign of said variation of rate to automatically correct the variation of rate at the output of said seconds counter;

said second logic circuit having a sign memory, a frequency selector, a reset selector for selectively resetting said two counters, and a locking device comprising at least one gate and an inverter.

* * * * *